US005101726A

United States Patent [19]

Lübke et al.

[11] Patent Number: 5,101,726

[45] Date of Patent: Apr. 7, 1992

[54] HINGE AND BEARING CONNECTION FOR PRESS HAVING REPLACEABLE SLEEVELIKE IMPRESSION CYLINDER SHELLS

[75] Inventors: Herbert Lübke, Lienen; Volker Schröder, Lengerich; Westermann, Heinz-Georg, Lotte, all of Fed. Rep. of Germany

[73] Assignee: Windmoller & Holscher, Lengerich, Fed. Rep. of Germany

[21] Appl. No.: 626,716

[22] Filed: Dec. 17, 1990

[30] Foreign Application Priority Data

Dec. 18, 1989 [DE] Fed. Rep. of Germany ..... 3941741
Mar. 16, 1990 [DE] Fed. Rep. of Germany ..... 4008501

[51] Int. Cl.[5] ..... B41F 5/00

[52] U.S. Cl. ..... 101/216; 101/153; 101/375

[58] Field of Search ..... 101/152, 153, 216, 219, 101/175, 177, 375, 376, 142, 349

[56] References Cited

U.S. PATENT DOCUMENTS

| | | | |
|---|---|---|---|
| 3,789,757 | 2/1974 | Motter et al. | 101/153 |
| 4,111,120 | 9/1978 | Paulson | 101/175 |
| 4,119,032 | 10/1978 | Hollis | 101/375 |
| 4,807,527 | 2/1989 | Knauer | 101/216 |
| 4,876,958 | 10/1989 | Townsend | 101/175 |
| 4,901,641 | 2/1990 | Steiner et al. | 101/152 |
| 4,932,322 | 6/1990 | Keller | 101/219 |
| 4,934,264 | 6/1990 | Gansky et al. | 101/175 |
| 4,967,658 | 11/1990 | Townsend | 101/175 |

FOREIGN PATENT DOCUMENTS 3500319 6/1986 Fed. Rep. of Germany .

*Primary Examiner*—Edgar S. Burr
*Assistant Examiner*—Ren Yan
*Attorney, Agent, or Firm*—Fleit, Jacobson, Cohn, Price, Holman & Stern

[57] ABSTRACT

An impression cylinder provided with a replaceable sleevelike impression cylinder shell is movably and releasably mounted in a printing press by a bearing in such a manner that the impression cylinder adjacent to its one stub shaft is adapted to protrude freely from the machine frame and permit replacement of the impression cylinder shell. In order to permit a particularly simple replacement of the impression cylinder shell, the bearings are hinged bearings having bearing shell sections which can be swung off to a position in which they permit the impression cylinder to be swung out in a horizontal plane. The impression cylinder is provided at one end with a stub shaft, which extends beyond the associated hinged bearing and which at the top of its end portion is supportedd by a supporting shell section, which is axially immovably mounted in the machine frame for rotation about a vertical axis. A movable horizontal supporting rail or slideway is provided, which is movable from below into engagement with the impression cylinder, or with a shaft portion connected to the cylinder, at a location between the bearings. The rail or slideway is adapted to be fixed in position, so that the impression cylinder which is held between the supporting shell section and the supporting rail can be pivotally moved out of the opened hinged bearings about the vertical pivot for the supporting shell section.

7 Claims, 5 Drawing Sheets

1
2
42
41
VI
VI
38
3
37
8
9
12
10
7
11
4
33
5
34
13
35
32
14,15
6
17
III
16
III
18
20
19
21
28
31
27
29
25,26

HINGE AND BEARING CONNECTION FOR PRESS HAVING REPLACEABLE SLEEVELIKE IMPRESSION CYLINDER SHELLS

BACKGROUND OF THE INVENTION

1. Field of the Invention

This invention relates to a printing press comprising at least one impression cylinder, which is provided with at least one replaceable sleevelike impression cylinder shell and bearings for releasably mounting the impression cylinder in the machine frame. The impression cylinder is adapted to freely protrude from the machine frame adjacent to one stub shaft so as to permit a replacement of the impression cylinder shell.

2. Description of the Prior Art

In a known printing press, such as that disclosed by German Patent Specification 35 00 319, a bearing can be detached by pulling the bearing, together with the associated bearing block, which is slidably mounted on guide rods, from a stub shaft of the impression cylinder. When the bearing has been pulled off and the guide rods have been detached from a carrying side wall, the bearing and the bearing block can be swung out by means of a pivoted U-shaped member. The impression cylinder shell can then be pulled from the impression cylinder, which is then held between an extensible supporting shell and a retractable supporting yoke provided in the other, non-detached bearing. In the known printing press, however, the means for removing one bearing and for holding the impression cylinder in the other bearing to protrude freely therefrom are relatively expensive, and a complete pulling of a bearing and the associated bearing block from a stub shaft of the impression cylinder will not be possible unless a side wall in which the impression cylinder is rotatably mounted is formed with an aperture. Even if the provision of such aperture is not prevented by structural considerations, the aperture will weaken the side wall and, therefore the entire machine frame.

SUMMARY OF THE INVENTION

It is an object of the invention to provide a printing press of the kind described above and which permits an impression cylinder shell to be replaced in a simple manner.

In a printing press of the kind described, that object is accomplished in accordance with the invention in that the bearings are hinged bearings having bearing shell sections which can be swung off to a position in which they permit the impression cylinder to be swung out in a horizontal plane. The impression cylinder is provided at one end with a stub shaft, which extends beyond the associated hinged bearing and which at the top of its end portion is supported by a supporting shell section, which is axially immovably mounted in the machine frame for rotation about a vertical axis. A movable horizontal supporting rail or slideway is provided, which is movable from below into engagement with the impression cylinder, or with a shaft portion connected to the cylinder, at a location between the hinged bearings. The rail or slideway is adapted to be fixed in position, so that the impression cylinder which is held between the supporting shell section and the supporting rail can be pivotally moved out of the opened hinged bearings about the vertical pivot for the supporting shell section. As a result, a printing press in accordance with the invention permits an impression cylinder shell to be replaced in a simple manner, because means are provided by which the impression cylinder is held when the hinged bearings have been opened and which permit pivotal movement of the impression cylinder about a vertical axis close to one hinged bearing. When the impression cylinder has been swung out and protrudes freely in an oblique position, the impression cylinder shell that is to be replaced can be pulled from the impression cylinder.

The hinged bearings are of known type and can be opened and closed quickly. As the impression cylinder is swung out about the vertical pivot for the supporting shell section, which constitutes one abutment for the impression cylinder, the other abutment will be constituted by the slideway of the supporting rail when that slideway has been moved into engagement with the impression cylinder.

The supporting shell member may consist of a shell section of a sliding surface bearing and, in that case, need not be removed during the printing operation.

The supporting rail is suitably held on the end portion of a supporting lever, which is pivoted to the machine frame, and supporting means are provided for pivotally moving that supporting lever between a holding position, to which the lever has been swung out, and a stand-by position, to which the lever has been swung in. The supporting rail may be secured to the piston rod of a fluid-operable piston-cylinder unit. The supporting lever which carries the supporting rail may also be pivotally movable by a fluid-operable piston-cylinder unit.

The supporting means suitably comprise a toggle joint, which at one end is pivoted to the supporting lever and at its other end is pivoted to the machine frame. The joint is adapted to be blocked in an extended position, in which the toggle joint holds the lever in its supporting position. One of the toggle arms is suitably formed with a groove, and the other toggle arm is movably mounted in the side walls of that groove so that the other toggle arm, when it has been swung in, will partly be received by the groove. Such as design permits the provision of compact supporting means, because the toggle joint and the supporting lever constitute a four-bar linkage, which can be collapsed to a position in which the supporting lever has been swung in and contacts the outer toggle arm and is parallel thereto.

In accordance with a further feature of the invention, the supporting lever and the toggle joint are so arranged in the recess formed in a side part of the machine frame that the supporting lever and the toggle joint can be swung into the recess. This feature permits a space-saving design, and it is not necessary to form side parts of the machine frame with weakening apertures.

The outer toggle arm is desirably secured to a shaft which is rotatably mounted in and extends between forked bearing members and is connected to an actuating lever by which the shaft can be turned to pivotally move the toggle joint between its supporting position and its position of rest. The actuating lever may be secured to the shaft by a ring, which is provided with a detent pin. The detent pin is adapted to snap into associated detent bores of a bearing member when the toggle joint is in its supporting position and its position of rest so that the toggle joint will be locked in each of these positions.

DETAILED DESCRIPTION OF THE PREFERRED EMBODIMENT

Figure 1:
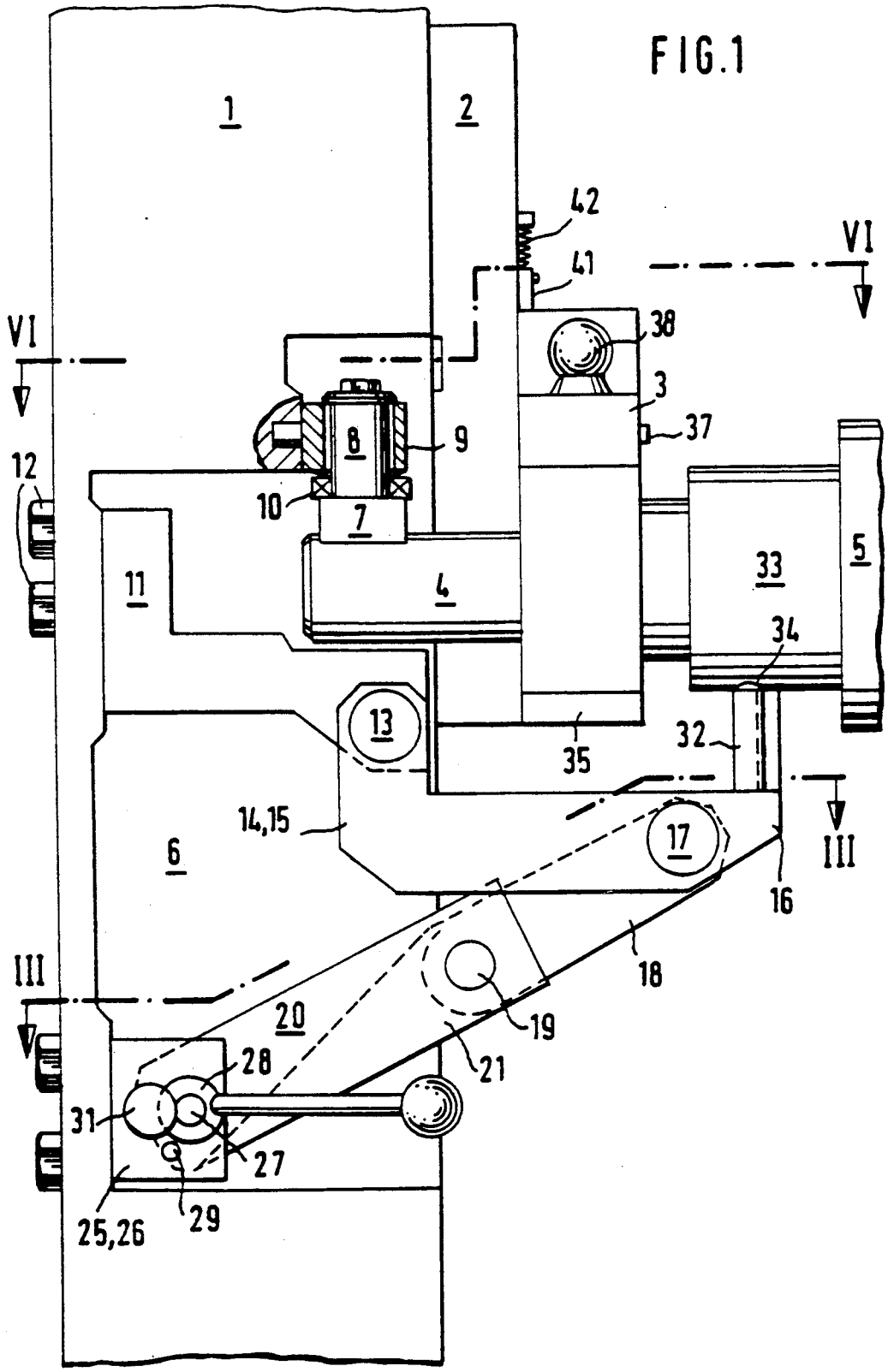
FIG. 1 is a side elevation view showing means for mounting an impression cylinder in a side part of a printing press in a position in which the hinged bearing has been opened and a supporting rail has been moved into engagement with the impression cylinder which is movably mounted at one end and protrudes freely.

An illustrative embodiment of the invention will now be explained in more detail with reference to the drawings.

The left-hand side frame 1 of a gravure press, shown only in part is provided on its inside face with a plate 2, which is to the left-hand side frame by screws (not shown). In a manner which is known per se, the plate 2 carries a hinged bearing 3, in which a stub shaft 4 extending from the left end of a sleeve-like impression cylinder 5 is rotatably mounted. The right-hand side frame of the gravure press, which is opposite to the side frame 1, is not shown, but, is also provided with a plate substantially the same as plate 2 which carries a hinged bearing for mounting a right-hand side stub shaft extending from the right end of cylinder 5. The two side frames are identical in that respect. However, the stub shaft 4 at the left end of the impression cylinder 5 extends and protrudes into a recess 6 formed in the side frame 1. A shell section 7 of a sliding surface bearing is mounted on that extended stub shaft 4 and is fixed to a pin 8. Pin 8 is rotatably mounted in a bracket 9, which is fixed to the side frame 1. The forces acting on the shell section 7 of the sliding surface bearing are applied, via a thrust bearing 10, to the bracket 9.

Figure 2:
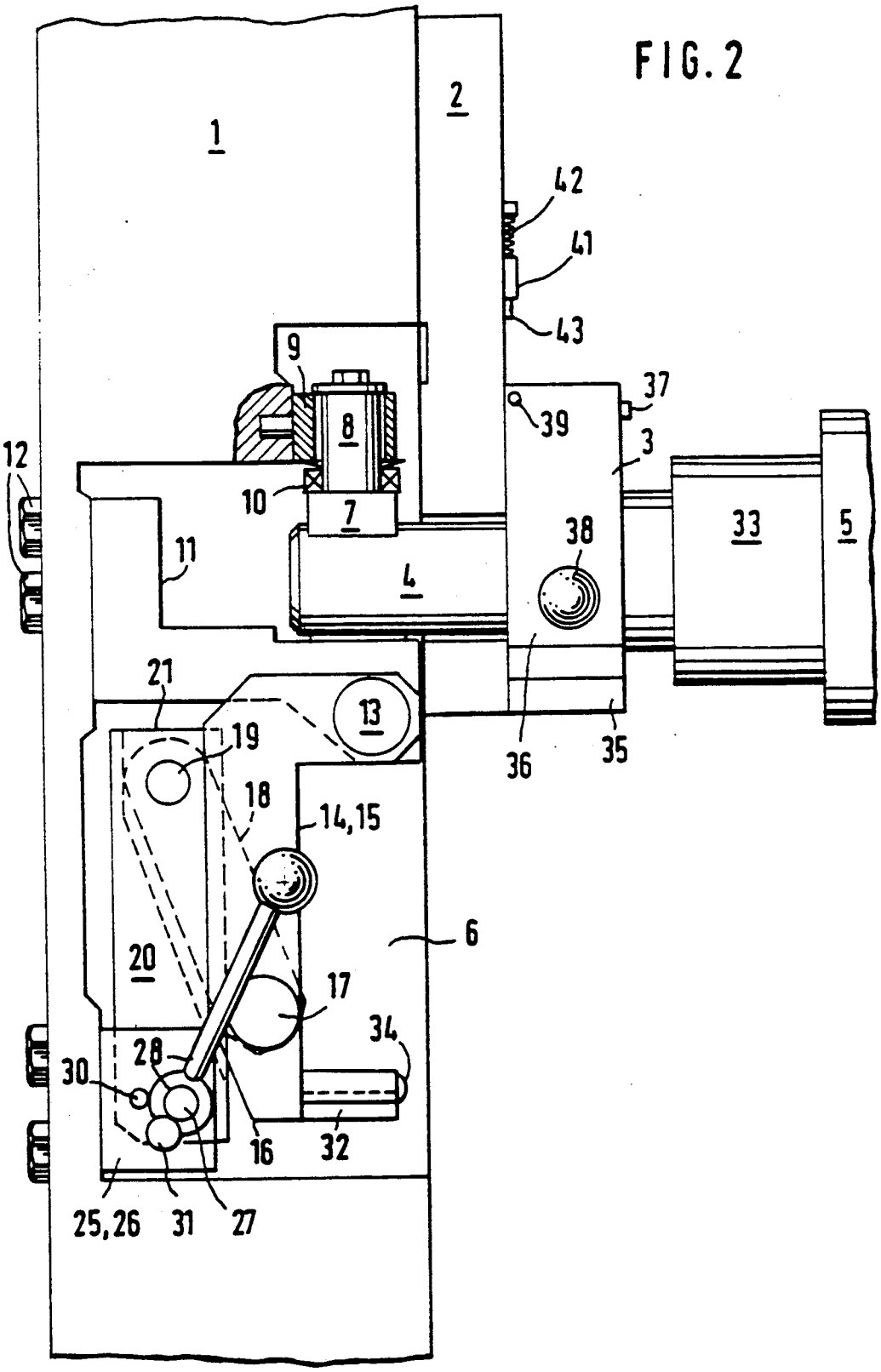
FIG. 2 is a side elevation view which is similar to FIG. 1 and shows a position in which the hinged bearing is closed and the supporting means have been swung in to a position of rest.
Figure 3:
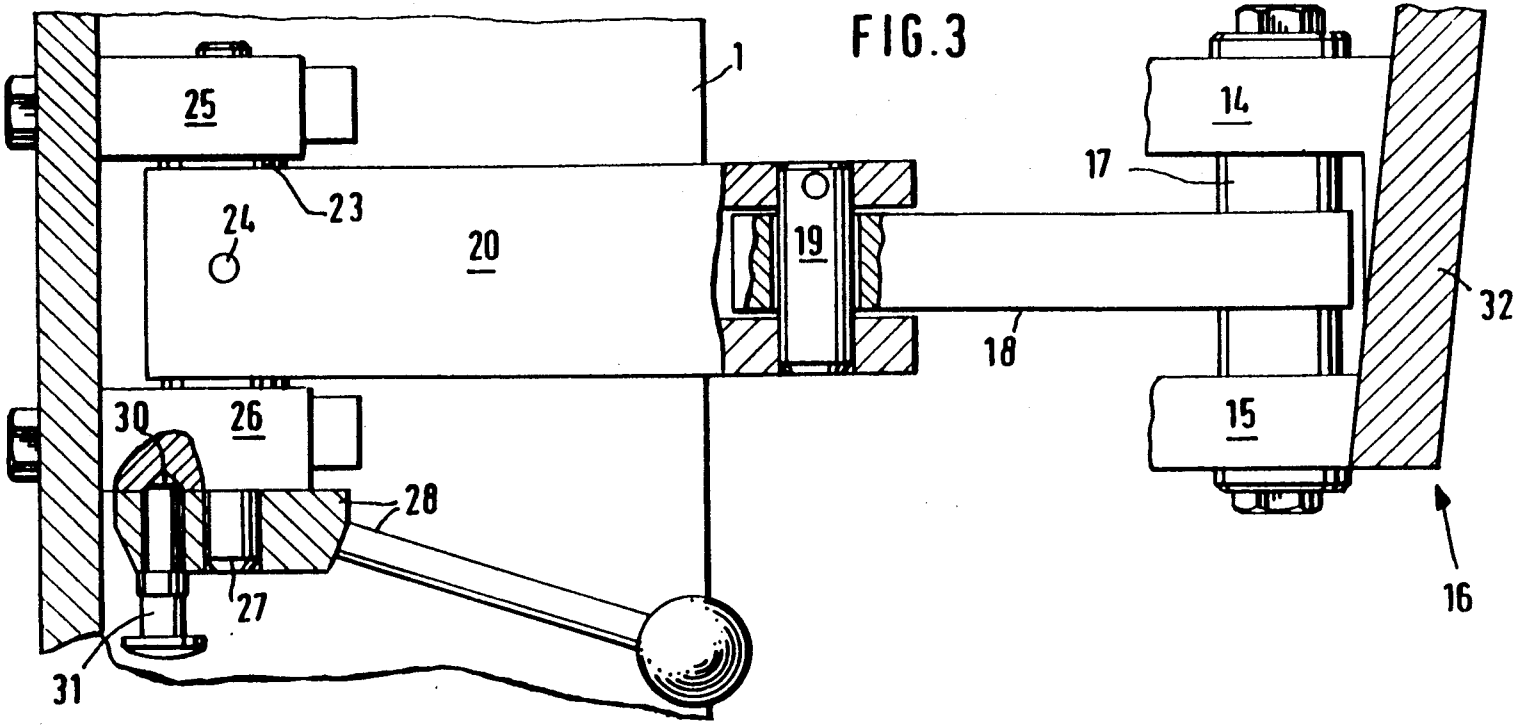
FIG. 3 is a side elevation view showing the supporting means partly in section taken on line III—III of FIG. 1.
Figure 5:
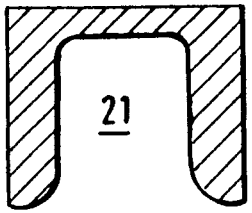
FIG. 5 is a sectional view taken on line V—V in FIG. 4 and showing the toggle arm.
Figure 4:
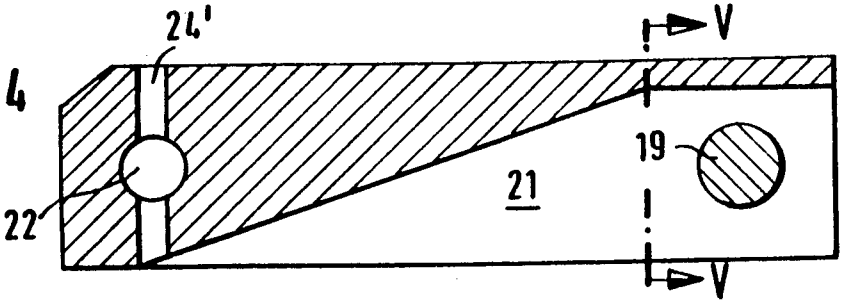
FIG. 4 is a sectional view showing a toggle arm of the supporting system.

A holder 11 is disposed beside the bracket 9 and is fixed by screws to the left-hand side frame 1. The two side bars 14 and 15 of a U-shaped lever 16 are pivotally connected by the pin 13 to the holder 11. Another pin 17 is mounted in and extends between the two side bars 14 and 15 at that end of the lever 16 which is remote from the pin 13. A toggle arm 18 is freely pivoted on the pin 17, between the side bars 14 and 15. At that end which is remote from the pin 17 the toggle arm 18 is freely pivoted by another pin 19 to another toggle arm 20. As is apparent from FIG. 4, toggle arm 20 consists of a massive member, which is formed with a milled groove 21, which decreases in depth toward a bearing bore 22 of the toggle arm 20. A shaft 23 is mounted in the bearing bore 22 and is fixed to the toggle arm 20 by means of a locking pin 24, which is inserted in a bore 24' extending through toggle arm 20 and intersecting bore 22. On both sides of the toggle arm 20, the shaft 23 encluding a portion 27 which is rotatably mounted in holders 25 and 26, which are fixed to the side frame 1. The shaft 23 protrudes outwardly from the holder 26, and a handle 28 is fixed to the protruding portion 27 of the shaft 23. The holder 26 has two detent bores 29 and 30, as is shown in FIGS. 1 and 2. Depending on the angular position of the handle 28, a locking member 31, associated with the handle extends into either one of the detent bores 29 and 30. The handle is locked in one of two angular positions relative to the holder 26 by cooperation of the locking member 31 and the detent bore 30 when the arrangement is in the position shown in FIGS. 1 and 3. It is also apparent from the drawings that the U-shaped lever 16 is provided, at an end thereof which is opposite to the pivotal connection to holder 11 and remote from the side frame 1, with a slide rail 32, which bears from below against an extension 33 of the impression cylinder 5.

Figure 6:
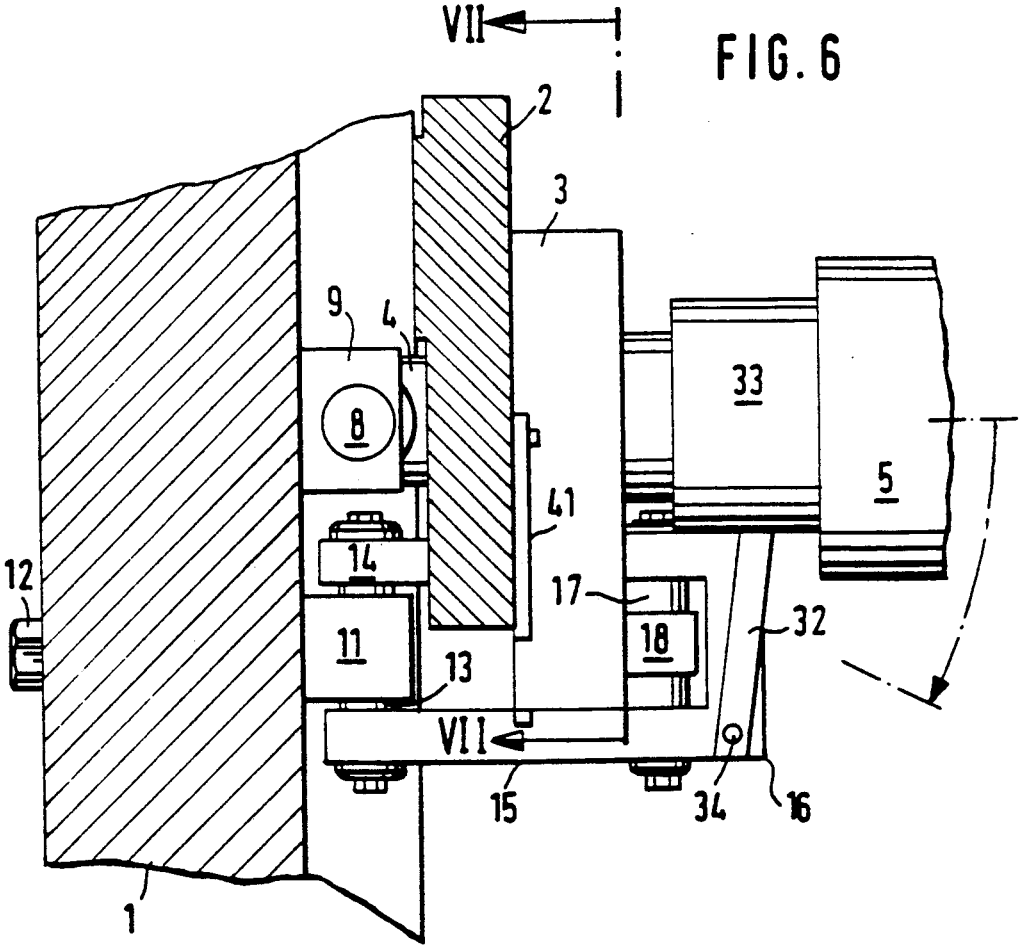
FIG. 6 is a sectional view taken on line VI—VI in FIG. 1 and showing the supporting system.

When the hinged bearing 3 and the hinged bearing which is associated with the side frame that is not shown are opened, the impression cylinder 5 can be swung out about the pin 8 while the impression cylinder is supported at one location by the stub shaft 4 on the bracket 9 and at another location on the slide rail 32. Outward pivotal movement of the impression cylinder 5 is limited by a stop 34 that is provided on the slide rail 32 and defines an end position for the cylinder. In that end position, one sleevelike impression cylinder shell can be replaced by another. After this has been effected, the impression cylinder is swung back to its initial position, shown in FIG. 6, and the hinged bearing 3 and the hinged bearing provided on the right-hand side frame (not shown) are closed. The locking member 31 is then disabled and the handle 28 is operated to rotate the shaft 23 in a counterclockwise sense until the handle 28 is in the position shown in FIG. 2. In the position of the arrangement shown in FIG. 2 the handle 28 and the shaft 23 are held in position by the locking member 31 and the detent bore 29. During the pivotal movement which has been described, the toggle arm 20 is pivotally raised from the position thereof shown in FIG. 1 to the position shown in FIG. 2 and the toggle arm 18 partly enters the milled groove 21 of the toggle arm 20 is, the toggle arm 18 swings down about the pin 19. By this pivotal movement, the U-shaped lever 15 swings down about the pin 13 of the holder 11 so that the U-shaped lever 16 also enters the recess 6 of the side frame 1, as is shown in FIG. 2. It is apparent that the entire mechanism which permits an outward pivotal movement of the impression cylinder for replacement of sleevelike impression cylinder shells is accommodated in the recess 6 during a normal printing operation and, as a result, will not add to the overall size of the printing press.

Figure 7:
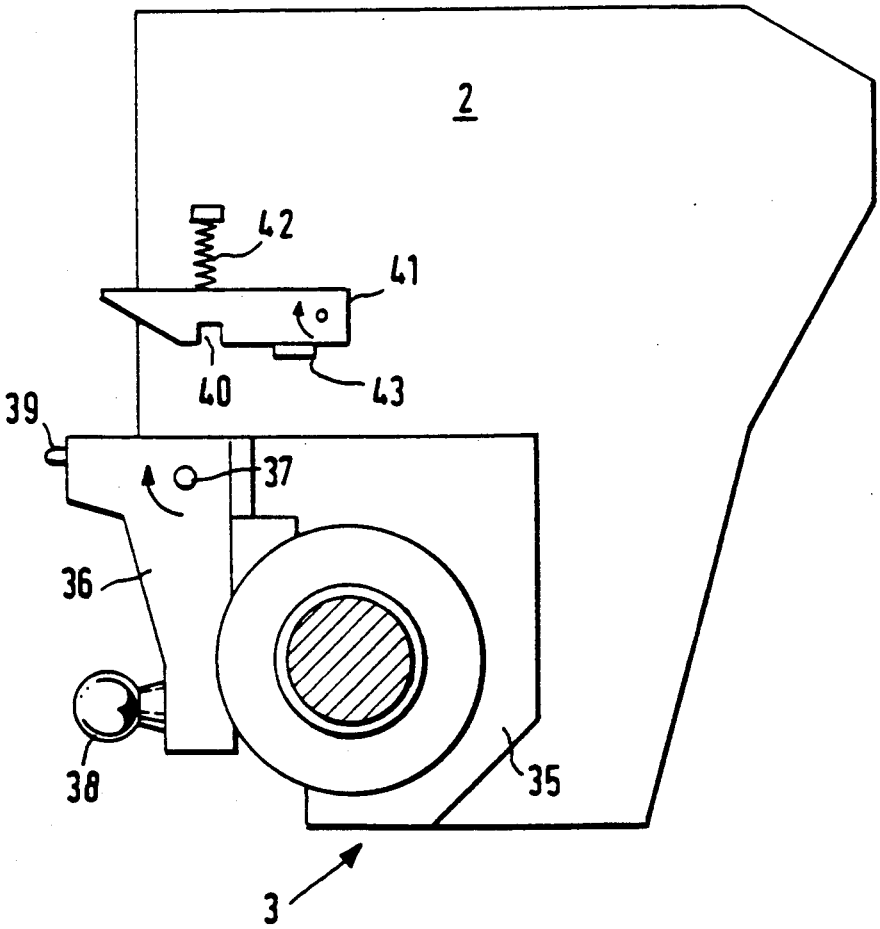
FIG. 7 is an elevational view showing a hinged bearing, partly in section taken on line VII—VII in FIG. 6.

The hinged bearing 3 is shown in an open position in FIG. 1 and in a closed position in FIG. 2. In FIGS. 1 and 2, the hinged bearing 3 is shown in side elevation. It is apparent that the hinged bearing consists of a fixed part 35 and a pivotable part 36, which is pivoted about an axis of pin 37. When the forward part 36 of the hinged bearing 3 is manually pivotally raised, by means of a handle 38, the locking pin 39 enters a recess 40 of a detent lever 41. Detent lever 41 urged against a stop 43, provided on plate 2 by a compression spring 42. The hinged bearing is diagrammatically shown in FIG. 7.

The connection described above for releasably mounting an impression cylinder is particularly suitable for mounting impression cylinders of gravure presses, in which much higher pressures are applied than in flexographic presses. The described mounting means do not require the side parts of machine frames to include apertures, which could weaken the frames.

We claim:

1. A printing machine comprising:

a machine frame, at least one impression cylinder provided with at least one replaceable sleevelike impression cylinder shell, hinged bearings connected to said machine frame and disposed at the two ends of said impression cylinder for releasably mounting said impression cylinder in said machine frame so that said impression cylinder may protrude freely from said machine frame so as to permit replacement of the impression cylinder shell, said hinged bearings having bearing shell sections which can be swung off to a position that permits one end of said impression cylinder to be swung out horizontally from said machine frame, said impression cylinder being provided at the other end with a stub shaft which extends beyond the associated hinged bearing, a supporting shell section disposed in said machine frame for supporting said stub shaft at the top portion, said supporting shell section being axially immovably mounted in said machine frame for rotation about a vertical pivot axis, and a shaft portion mounted on said impression cylinder at a location between said hinged bearings, a movable horizontal supporting rail and means mounting said supporting rail for selective activation to engage the underneath of said shaft portion, said impression cylinder being held between said supporting shell section and said supporting rail so as to pivotally swing about said vertical pivot axis of said supporting shell section out of said machine frame at said one end when said hinged bearings are opened.

2. A printing machine according to claim 1, characterized in that the supporting shell section is a shell of a sliding surface bearing.

3. A printing machine according to claim 1, and further comprising a supporting lever having an end portion holding the supporting rail, said supporting lever being pivoted to the machine frame, and supporting means for pivotally moving the supporting lever between a holding position, to which the lever has been swung out, and a stand-by position, to which the lever has been swung in.

4. A printing machine according to claim 3, wherein the supporting means comprise a toggle joint, said toggle joint having one end pivoted to the supporting lever and another end pivoted to the machine frame, said toggle joint being blocked in an extened position, in which the toggle joint holds the supporting lever in its supporting position.

5. A printing machine according to claim 4, wherein said machine frame includes a side part and a recess formed in said side part, the supporting lever and the toggle joint being arranged in the recess formed in the side part of the machine frame so that the supporting lever and the toggle joint can be swung into the recess.

6. A printing machine according to claim 4, wherein said toggle joint includes an outer toggle arm, and further comprising a shaft to which said outer toggle arm is secured, and forked bearing members in which said shaft is rotatably mounted and between which said shaft extends, said shaft being connected to an actuating lever by which the shaft can be turned to pivotally move the toggle joint between a supporting position and a position of rest.

7. A printing machine according to claim 6, and further comprising a ring for securing the actuating lever to the shaft, a detent pin provided on the ring, and a bearing member having detent bores into which the detent pin is adapted to snap when the toggle joint is in its supporting position and position of rest.

* * * * *